US009080319B2

(12) United States Patent
Oates, Jr. et al.

(10) Patent No.: US 9,080,319 B2
(45) Date of Patent: Jul. 14, 2015

(54) SYSTEMS AND METHODS FOR ATTACHMENT CONTROL SIGNAL MODULATION

(75) Inventors: Richard H. Oates, Jr., Casper, WY (US); Lukas M. Munsell, Casper, WY (US); Terry W. Stone, Casper, WY (US)

(73) Assignee: WYOMING MACHINERY COMPANY INC., Casper, WY (US)

( * ) Notice: Subject to any disclaimer, the term of this patent is extended or adjusted under 35 U.S.C. 154(b) by 580 days.

(21) Appl. No.: 13/449,278

(22) Filed: Apr. 17, 2012

(65) Prior Publication Data

US 2013/0274925 A1 Oct. 17, 2013

(51) Int. Cl.

| | |
|---|---|
| ***G05B 13/00*** | (2006.01) |
| ***E02F 3/96*** | (2006.01) |
| ***E02F 9/22*** | (2006.01) |
| ***E02F 9/26*** | (2006.01) |

(52) U.S. Cl.
CPC ..... *E02F 3/96* (2013.01); *E02F 9/2228* (2013.01); *E02F 9/267* (2013.01)

(58) Field of Classification Search
USPC ..... 700/275; 172/272; 702/183
See application file for complete search history.

(56) References Cited

U.S. PATENT DOCUMENTS

| | | | | |
|---|---|---|---|---|
| 5,590,731 | A | 1/1997 | Jacobson | |
| 5,957,213 | A | 9/1999 | Loraas et al. | |
| 6,202,014 | B1 | 3/2001 | Brandt et al. | |
| 6,542,789 | B2 | 4/2003 | Ufheil | |
| 6,662,881 | B2 | 12/2003 | Domann | |
| 6,923,285 | B1 | 8/2005 | Rossow et al. | |
| 7,017,674 | B2 * | 3/2006 | Bell et al. | 172/2 |
| 7,099,722 | B2 * | 8/2006 | Casey | 700/85 |
| 7,496,441 | B2 * | 2/2009 | Brandt et al. | 701/50 |
| 7,725,294 | B2 * | 5/2010 | Mindeman et al. | 702/183 |
| 7,890,236 | B2 * | 2/2011 | Osborn | 701/50 |
| 2002/0013642 | A1 * | 1/2002 | Choi et al. | 700/275 |
| 2009/0171482 | A1 * | 7/2009 | Mindeman et al. | 700/83 |
| 2012/0109459 | A1 * | 5/2012 | Bichler et al. | 701/41 |
| 2013/0274925 | A1 * | 10/2013 | Oates et al. | 700/275 |

OTHER PUBLICATIONS

United States International Preliminary Examination Authority; International Preliminary Report on Patentability for PCT/US2012/033949; May 6, 2014; 16 pages; Alexandria, VA; US.

* cited by examiner

*Primary Examiner* — Robert Fennema
*Assistant Examiner* — Anthony Whittington
(74) *Attorney, Agent, or Firm* — Underwood & Associates, LLC

(57) ABSTRACT

In general, systems and methods for controlling work machine implements are described. In one embodiment, a system for controlling a hydraulically-powered third-party work machine implement includes a microcontroller-based conversion module capable of transforming implement control signals from their native format (e.g., PWM) to a signal format required by the implement to function properly (e.g., digital). A hydraulic flow activation signal can be simultaneously generated and transmitted to the implement so that hydraulic flow occurs only when control signals are received and the implement is caused to be in motion or otherwise activated.

20 Claims, 10 Drawing Sheets

SYSTEMS AND METHODS FOR ATTACHMENT CONTROL SIGNAL MODULATION

TECHNICAL FIELD

This disclosure relates to systems and methods for controlling machines, machine peripherals, attachments, implements, and the like.

BACKGROUND

Work machines can be used in various industries and are particularly suited for performing tasks such as earth-moving, digging, drilling, and transporting heavy objects. In general, work machines such as backhoes, bulldozers, skid steer loaders, and cranes commonly use some form of mechanical advantage to carry out tasks requiring exceptional strength or force, e.g., to move large, heavy objects or earth. Commonly, hydraulic machinery is used for lifting heavy loads, articulating booms, and controlling other features of work machines.

Attachments can be used with work machines for carrying out specific tasks or performing certain operations. Examples of work machine attachments include augers, brooms, excavator buckets, stump grinders, and trenchers, and most, if not all attachments operate by hydraulic power.

SUMMARY

In general, systems and methods are disclosed for controlling work machines, work machine attachments, and implements thereof In one exemplary aspect, a system for controlling a work machine implement is described. The system includes an electronic control module circuit capable of receiving, at one or more input registers, an input control signal of a first control signal type generated by a control mechanism of the work machine corresponding to a user input. The circuit is further capable of generating a control output signal of the first control signal type or of a second, different control signal type for controlling operation of the implement according to the user input. Generating an output signal causes simultaneous or substantially simultaneous generation of a hydraulic flow output control signal for providing hydraulic power to the implement. The control output signal and the hydraulic flow output control signal are transmitted to an output register.

In one embodiment, the hydraulic flow output control signal is in signal communication with an electronic control module of the work machine that is capable of controlling hydraulic flow to a hydraulic motor or hydraulic cylinder integral with the work machine implement.

In one embodiment, the manufacturing company of the work machine is different from the manufacturing company of the implement. In one embodiment, the implement includes an electronic control module for controlling movement or functionality of the implement using one or more hydraulic systems, and wherein the electronic control module is configured to receive a control signal of a different type than that produced by the control mechanism.

In one embodiment, the control module circuit includes a microcontroller in signal communication with the one or more input registers that is capable of storing and executing software instructions for converting the one or more input control signals from the first control signal type into the output signals of the second control signal type, alone, or optionally in cooperation with one or more electronic filter components. In one embodiment, the microcontroller is capable of storing one or more configuration files that include software instructions for a chosen combination of work machine and implement. In one embodiment, the system further includes a selection mechanism for a user to select one of the configuration files to be executed by the microcontroller according to a chosen combination of work machine and implement. In one embodiment, the selection mechanism is a computer-driven, graphical user interface, a switch, a rotary dial, a lever, or a button. In one embodiment, the system further includes one or more optional electronic filters and one or more optional electronic regulators in signal communication with the input control signals, which are capable of conditioning the one or more input control signals according to desired signal input specifications of the microcontroller.

In one embodiment, the first control signal type is a pulse-width modulated (PWM) signal, an analog signal, a digital signal, an alternating-current signal, or a direct-current voltage signal.

In one embodiment, the control mechanism is a joystick, lever, throttle, auxiliary control module, pedal, switch, roll-knob, or control bar.

In one embodiment, the work machine is a skid-steer loader, an excavator, a multi-terrain loader, a telehandler, a track loader, a track-type tractor, a wheel loader, a wheel dozer, a motor grader, or a backhoe loader.

In one embodiment, the implement is one or more of a: motor grader, backhoe, hydraulic breaker, fork, pallet fork, broom, angle broom, sweeper, auger, mower, snow blower, grinder, stump grinder, tree spade, trencher, dumping hopper, ripper, tiller, grapple, tiller, roller, blade, snow blade, wheel saw, cement mixer, bucket, clamp, digger, cutter, grader, grapple, breaker, mower, rake, planer, compactor, ripper, scraper, seeder, sprayer, spreader, trencher, plow, roller, wheelsaw, post driver, dumping hopper, chipper, or wood chipper.

In one exemplary aspect, a method for controlling an implement of a work machine is described. The method includes receiving an implement control signal in a first signal format from a work machine implement control mechanism at an input register of a conversion module. The conversion module includes a microcontroller in signal communication with the input register, and the microcontroller is capable of storing and executing computer software instructions for converting the implement control signal from the first signal format to a second, different signal format. The method further includes transmitting the implement control signal in the second signal format to an electronic control module integral with the implement that is configured to receive control signal of the second signal format to engender user-controlled motion or activation of the implement.

In one embodiment, the method further includes generating a hydraulic flow activation signal that corresponds with converting the implement control signal from the first signal format to a second signal format. The method further includes transmitting the hydraulic flow activation signal to an input register of a hydraulic power system integral with the implement, to cause hydraulic flow in the hydraulic power system to occur only when the implement is in motion or activated.

In one embodiment, the first or the second control signal format is a pulse-width modulated (PWM) signal, an analog signal, a digital signal, an alternating-current signal, or a direct-current voltage signal.

In one embodiment, the implement control mechanism is a joystick, lever, throttle, auxiliary control module, pedal, switch, roll-knob, or control bar.

In one embodiment, the work machine is a skid-steer loader, an excavator, a multi-terrain loader, a telehandler, a track loader, a track-type tractor, a wheel loader, a wheel dozer, a motor grader, or a backhoe loader, and wherein the implement is one or more of a: motor grader, backhoe, hydraulic breaker, fork, pallet fork, broom, angle broom, sweeper, auger, mower, snow blower, grinder, stump grinder, tree spade, trencher, dumping hopper, ripper, tiller, grapple, tiller, roller, blade, snow blade, wheel saw, cement mixer, bucket, clamp, digger, cutter, grader, grapple, breaker, mower, rake, planer, compactor, ripper, scraper, seeder, sprayer, spreader, trencher, plow, roller, wheelsaw, post driver, dumping hopper, chipper, or wood chipper.

In one exemplary aspect, a computer program product is described. The computer program product is tangibly embodied in an information carrier, the computer program product includes instructions that, when executed, perform operations for controlling a work machine implement that is configured to receive operative control signals in a format that is different from the signal format of the implement control system of the work machine. The operations include receiving an implement control signal in a first signal format from the implement control system of the work machine at an input register of a conversion module, where the conversion module includes a microcontroller in signal communication with the input. The operations further include converting the implement control signal from the first signal format to a second, different signal format. The operations further include transmitting the implement control signal in the second signal format to an input register of an electronic control module integral with the implement that is configured to receive control signals of the second signal format to engender user-controlled motion or activation of the implement.

In one embodiment, the operations further include instructions for selecting, through a graphical user interface, a configuration file corresponding to a specific combination of work machine type and implement type. The operations further include displaying, on the graphical user interface, selected operational data corresponding to the usage of the implement.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings in which like references indicate similar elements, and in which.

DETAILED DESCRIPTION OF ILLUSTRATIVE EMBODIMENTS

Figure 1:
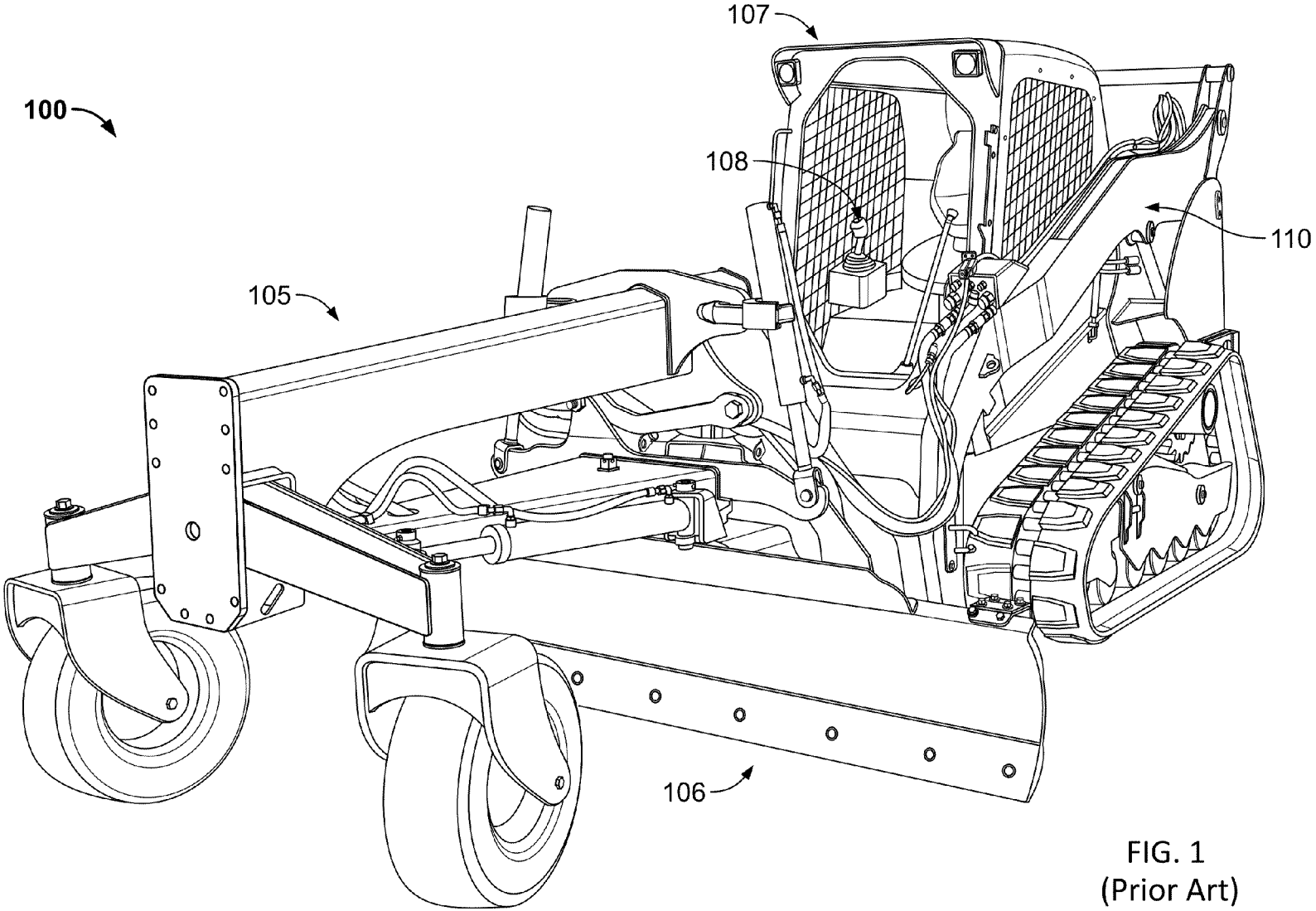
FIG. 1 (Prior Art)
FIG. 1 is a prior-art version of a skid steer/multi-terrain loader with a motor grader attachment.

In one exemplary aspect, systems and methods for attachment control signal modulation are disclosed. An electronic control and signal modulation system, hereinafter ECSMS, is disclosed for this and other purposes. In general, an ECSMS can receive one or more control signal input(s) of any signal type, e.g., pulse-width modulated (PWM), analog, digital, AC or DC voltage, or combinations thereof, and produce the correct output signal(s) necessary to power, control, or simultaneously power and control a work machine implement or attachment. In one embodiment, one or more control signals, which may be different signal types in the case of multiple control signals, are received by a signal modulator. The signal can be electronically filtered, converted, or other otherwise conditioned to produce an output signal capable of powering, controlling, or simultaneously powering and controlling a work machine attachment or implement. In one embodiment, signal filters, signal converters, or other signal-conditioning mechanisms can be embodied in computer hardware, software, firmware, or combinations thereof. In a preferred embodiment, an ECSMS can receive control input signals from a work machine joystick or other control device configured to control a first work machine attachment; the ECSMS is capable of producing output signals to simultaneously provide controlled hydraulic flow to, and mechanical movement of a second, different work machine attachment.

In one general aspect, the systems and methods for attachment control signal modulation described herein can provide the ability to control various machine implements or attachments, including third-party implements or attachments, using existing attachment control systems built in to the work machine. In one non-limiting example, some skid-steer loaders have control implements, e.g., control joysticks for controlling various work machine attachments, such as a six-way blade, a tree spade, a broom, a bucket, a trencher, a backhoe, or other implements. However, if a user wished to use an off-brand or third-party attachment with the skid-steer loader, special considerations or re-wiring may be needed so that the control implement can communicate with the attachment to cause it to work correctly, i.e., as expected.

In some cases, off-brand or third party attachments cannot be used with certain work machines because the control system is not configured to control attachments or implements other than those provided by the work machine manufacturer. Some manufacturers provide conversion kits that relay control signals to a third-party attachment, however, hydraulic flow to the attachment cylinders is typically required to be 'on' at all times. This can lead to damaged cylinders, which can be costly to replace.

In one embodiment, an ECSMS can receive any type of control signal from a control system and provide a conditioned output signal capable of controlling a mechanical attachment or implement as desired. Furthermore, an ECSMS is capable of simultaneously providing correct signals to control solenoids, hydraulics, and other power systems to work correctly with the mechanical implement. Keeping with the example above, an ECSMS can be used in work machines so that operators can control off-brand or third-party work machine attachments with the existing control system(s) of the work machine. In preferred embodiments, the ECSMS is capable of outputting any combination of power and control signals at desired signal levels or amounts individually, simultaneously, or in any desired combination thereof. Additionally, in preferred embodiments, an ECSMS is capable of outputting necessary hydraulic power signals and control signals simultaneously, thereby providing the capability of powering and controlling one or more machine implements.

FIG. 1 shows an exemplary prior-art work machine 100 having a work machine attachment 105 which will be used for illustrative purposes throughout this disclosure. This type of work machine will be easily recognizable as a skid-steer loader by those skilled in the art and represents one of many work machine types to which this disclosure is applicable. The attachment 105 will be recognized by those skilled in the art as a motor grader. Other work machines and other machinery in general are equally contemplated, including, but not limited to: heavy equipment (construction) machinery, such as bulldozers, excavators, wheel loaders, graders, compactors, conveyors, and the like; robotic machinery; automobiles; manufacturing equipment; controllers; and other machinery.

The work machine 100 includes a grader blade 106 on the attachment 105 that can be controlled by a user in the cab portion 107. The grader blade 106 (and the attachment 105 in general) can be raised and lowered via one or more lift arms 110, as well as tilted frontward and backward according to user input into a joystick controller 108. It will be understood that the joystick 108 shown in FIG. 1 is but one of many commercially-available control systems for use in work machines. Other non-limiting control systems include levers, pedals, switches, roll-knobs, control bars, and other control surfaces and mechanisms capable of sending control signals to various power plants and control mechanisms on the work machine 100, as is generally known in the art.

Other power sources may be used to maneuver the implements which are not shown in FIG. 1. For example, the grader blade 106 can be maneuvered wholly or in part by engine components, gears, other hydraulic cylinders, electronic or pneumatic power plants, etc. Those skilled in the art will recognize that a variety of commercially-available attachments can be coupled to a work machine to perform various tasks, including, but not limited to backhoes, hydraulic breakers, pallet forks, angle brooms, sweepers, augers, mowers, snow blowers, stump grinders, tree spades, trenchers, dumping hoppers, rippers, tillers, grapples, tilters, rollers, snow blades, wheel saws, cement mixers, and wood chipper machines.

Figure 2:
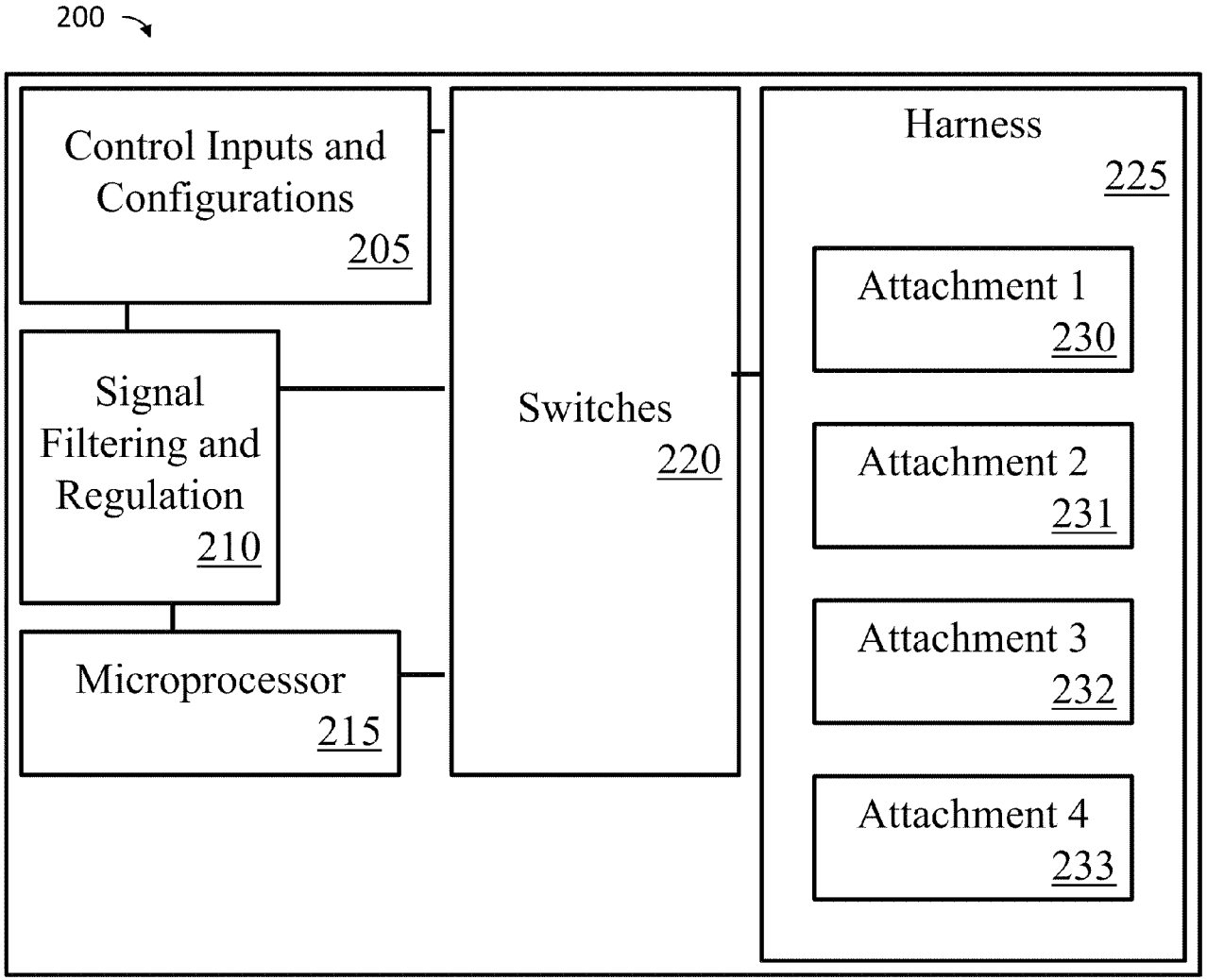
FIG. 2 shows an electronic control and signal modulation system, according to one embodiment.

Referring now to FIG. 2, an ECSMS 200 is shown according to one embodiment. In general, the ECSMS 200 can provide the capability of receiving input control signals of any type, e.g., PWM, AC, DC, analog, digital, etc., and optionally converting or conditioning those signals such that they produce an output signal capable of powering, controlling, or simultaneously powering and controlling a machine attachment or implement such as any of those described above. In a preferred embodiment, the ECSMS 200 is capable of providing control signals to hydraulic switches, e.g., solenoids, such that hydraulic flow is produced substantially only during the time that the attachment is being moved or otherwise requiring hydraulic power; and at other times, hydraulic flow to the attachment is substantially absent.

As is generally known in the art, machines, in particular, work machines such as the skid-steer loader shown in FIG. 1 have user-operable control mechanisms such as joysticks, levers, pedals, and other control surfaces that allow the user to control the machine and its attachments or implements. Many work machines are wired such that control signals from the various control surfaces and mechanisms are transmitted directly to a work machine attachment; the signals can be of a certain type (e.g., analog, PWM, etc.) and/or conditioned specifically for the attachment. As such, it can be difficult in some cases to replace an on-brand attachment with a third-party or off-brand attachment since the later may not be configured to receive control signals provided by the control surfaces and mechanisms.

In general, the ECSMS 200 includes one or more components and modules that will be described in greater detail below, e.g., plugs and harness components for receiving control inputs and configurations 205, a low-pass filter module 210, a microcontroller 215, etc. The various components and modules of the ECSMS 200 can be in signal communication with each other, and in some embodiments, the various components of the ECSMS 200 are capable of communicating directly with other components of the ECSMS 200 or other electronic components of a work machine. For example, in one embodiment, a signal from a control mechanism such as a joystick (e.g., joystick 108 in FIG. 1) can be received by the control input and configurations module 205 which can have one or more input registers; this signal can be sent directly to the switches module 220, or an attachment control module 230, thereby bypassing the low-pass filter 210 and the microcontroller 215. Such capability can be useful if, for example, a control signal received by the control input and configuration module 205 is suitable to directly control an attachment or implement. In general, "signal communication" refers to the sending and receiving of information; signals can be, e.g., electrical, digital, optical, analog, or any other type of signal.

In the embodiment of FIG. 2, the ECSMS 200 is capable of receiving a control signal from a machine, e.g., a work machine, via the control inputs and configurations module 205. This module 205 can include input registers, e.g., plugs, wiring harnesses, pins, and other signal connection devices and provides the capability for plugging existing signal control hardware (such as a Deutsch connector) into the ECSMS 200. For example, the control inputs and configuration module 205 can include a receptacle capable of receiving a plug that carries machine attachment control signals from one or more joystick controllers, buttons, levers, pedals, etc. In one embodiment, the plug receptacle can be a circular connector such as a so-called DIN connector commonly used to transmit control signals from a controller to a machine attachment. Any other type of electrical receptacle, including signal converters or adaptors can be used, including, but not limited to: MIDI, XLR, serial, coaxial, HDMI, USB, Deutsch, optical, twisted-pair cable, such as so-called Category-5 cable, and others.

The control input and configuration module 205 can include one or more switches, controllers, or harnesses for receiving control input from the user, e.g., for controlling work machine attachments, and also from sensors built-in to the work machine itself, e.g., roll-limit switches, speed governors, etc. Those skilled in the mechanical and automotive arts will appreciate that modern work machines are capable of producing a vast number of electronic signals and outputs throughout the machine, e.g., for monitoring engine performance, power output, fluid levels, hydraulic pressure, speed, mechanical strain, stress, and other factors. It will be understood that in this and other embodiments, an ECSMS can be capable of receiving such electronic signals for diagnostic or other purposes. Signals from the control input and configuration module 205 can be passed to other modules in the ECSMS 200, such as directly to the microcontroller 215, or to a control switch for an attachment (e.g., attachment 3 (232)).

Still referring to FIG. 2, in this embodiment, the ECSMS 200 includes a signal filtering and regulation module 210. The signal filtering and regulation module 210 can receive signals from the control input and configurations module 205 and provides the capability for one or both of signal filtering and regulation, so that the signals received by a control device (such as a joystick for controlling the grader blade 106 in FIG. 1) are clean and can be interpreted by the microcontroller 215. The amount and type of filtering and regulation performed by the module 210 can be dependent on several factors, such as the signal type, e.g., digital, analog, PWM, etc., the signal strength, noise, and other factors. It will be understood that the number of commercially-available attachment controllers as well as the many different types of machine attachments precludes a specific configuration of signal filters and/or regulators in this disclosure. However, those skilled in the electrical engineering arts will appreciate the numerous methods by which signal filtering, pre-conditioning, and regulation can be obtained so as to pass clean signals to the microcontroller 215. In one preferred embodiment, a low-pass filter includes a 3.3 kΩ resistor and a 0.1 μF capacitor for signal filtering; one or more 5 V regulators can be used to ensure input signals are regulating to ±5V or less prior to arriving at the microcontroller.

Still referring to FIG. 2, in this embodiment, the ECSMS 200 includes a microcontroller 215. The microcontroller 215 can receive control signals, and in some cases, control signals that have been filtered and conditioned by the signal filtering and regulation module 210. The microcontroller 215 can be programmed to convert—or transmit without conversion—any type of control signal, e.g., digital, analog, PWM, optical, etc., to the appropriate signal type necessary to control a machine attachment or implement, and in particular, a third-party or off-brand machine attachment or implement with respect to the work machine manufacturer.

Referring back to FIG. 1, consider, for example, that the work machine 100 is made by a particular company, and that the lift arms 110 are configured to control on-brand attachments using a combination of levers and the joystick 108 within the cab portion 107 of the vehicle. Continuing this example, consider that a user wishes to attach a third-party attachment (i.e., an attachment not made by the same company that manufactured the work machine 100)—in the case of FIG. 1, a grader blade attachment 105. Presumably, the signals generated by the work machine joystick 108 are meant to control on-brand attachments; there would be no expectation that the motor grader attachment 105 would function as expected using the joystick 108 as built and installed by the work machine manufacturer. However, continuing this example, the ECSMS 200 can be programmed to receive control signals from the joystick 108 and other work machine control mechanisms, and convert them into signals suitable to control the motor grader attachment 105 for its intended use. Furthermore, the ECSMS 200 can be programmed such that hydraulic flow to the attachment 105 is activated only when the user of the work machine 100 moves the joystick 108 or otherwise activates a function of the attachment requiring hydraulic power, such as moving the grader blade 106 up or down, or shifting it left or right. At all other times, the hydraulic flow can remain off. It will be understood that the foregoing example can be extended to virtually any machine attachment, so that third-party and off-brand attachments can be used on any brand of work machine, without losing control, functionality, or other features of the third-party or off-brand attachment.

Those skilled in the art of electrical engineering will appreciate the type of microcontroller suitable for the purposes described herein. In one embodiment, a suitable microcontroller is an Atmega328 RISC-based microcontroller. The microcontroller 215 can be programmed with any suitable software package capable of providing instructions for one or more of the following: receiving signals corresponding to work machine attachment control input; manipulating, converting, filtering, or regulating these control signals, and generating output control signals capable of powering and/or controlling a third-party work machine attachment or implements. In one embodiment, a suitable software package for programming the microcontroller 215 is provided under the open-source Arduino environment. The microcontroller 215 can be capable of generating output signals of any type, e.g., analog, digital, PWM, optical, etc., as previously described.

In a preferred embodiment, the ECSMS 200 includes a port allowing the microcontroller 215 to be reprogrammed while allowing at least the microcontroller to remain attached to a work machine. In some embodiments, the ECSMS 200 can be packaged in a rugged enclosure capable of being attached to a frame portion of the work machine. Thus, users are provided the capability of using multiple attachments with a single work machine; i.e., each time an attachment is changed, the control instructions for that particular implement can be uploaded to the microcontroller 215. In some embodiments, an ECSMS has a USB connection allowing programs to be uploaded to the microcontroller without having to remove or adjust any of the ECSMS 200 hardware. The microcontroller allows for numerous inputs and outputs to be controlled simultaneously based on the programming. In general, any number of inputs and outputs can be programmed to control, receive, and output any combination of signals simultaneously or in any desired sequence.

In one embodiment, an ECSMS is capable of storing one or more configuration files that relate to the configuration of a work machine, work machine attachment(s), or combinations thereof. Such configuration files can be specific for a work machine/third-party attachment combination, and enables the control of the third-party attachment using existing work machine controls as described herein. For example, a work machine user may frequently switch back and forth between two attachments—the first attachment being a digger, and the second attachment being a cutter (wherein the aforementioned examples are two of many attachment possibilities). To function properly, the digger and the cutter may require different control signals and have different power requirements, e.g., hydraulic power requirements, etc. The ECSMS can be capable of outputting the correct signals to power and control each attachment as described herein; however, the ECSMS may require different executable code for each attachment. In this and other embodiments, the ECSMS can store each of the programmed instructions required for proper functionality of the two attachments as configuration files. Thus, continuing the example, when a user switches a work machine attachment, he simply selects the proper configuration file that allows the ECSMS to output the correct signals to power and control the attachment.

In one embodiment, an ECSMS includes a graphical user interface (GUI) that provides the capability for a user to select between different configuration files that can be used by the ECSMS processor to power and control a given work machine attachment. In one embodiment, the GUI can be integral with a housing that contains the ECSMS microcontroller. In such an embodiment, the housing can be attached to the frame or other part of the work machine, and a user can select from one or more configuration files to load into memory when a work machine is attached.

In one embodiment, an ECSMS can include other types of controls that cause the ECSMS to load or otherwise use a proper configuration file for a given work machine attachment. For example, an ECSMS can include a dial having several selectable positions, e.g., 3, 6, 9, and 12-o'clock positions, each of which represents a different work machine attachment, and, correspondingly, causes the appropriate configuration file to be loaded so that the attachment can be controlled by existing work machine control mechanisms (e.g., joysticks, etc.).

In all embodiments, the term "loaded"—as it relates to software and executable instructions—carries its ordinary meaning in the computer and software arts. In general, "loading" instructions can include causing executable or readable instructions to be transferred from one storage medium, such as a flash drive, into a memory or storage device, such as a hard drive, RAM, or other type of storage medium, so that the executable or readable instructions can be carried out by a processor, e.g., microcontroller 215.

Still referring to FIG. 2, a switches module 220 includes electronic switches that are capable of being controlled by output from the microcontroller 215. Switches can be toggled, e.g., between 'on' and 'off' states to cause work machine attachment control signals to be sent to the harness 225. The harness 225 can include signal transmission hardware for one or more attachments, e.g., attachments 1-4, as illustrated in FIG. 2. Exemplary signal transmission hardware includes Deutsch connectors, among others. Control signals from the switches module 220 can be addressed or wired to specific outputs on the harness 225 corresponding to specific attachments, e.g., attachment 1 (230), attachment 2 (231), etc.

Thus, the ECSMS 200 can produce output signals for controlling a third-party work machine attachment as follows. First, a control signal from a work machine control mechanism (e.g., a joystick or lever) is received by the control inputs and configurations module 205. The signal can be passed to the signal filtering and regulation module 210, where it can be conditioned, or converted into a signal that is capable of being used by the microcontroller 215. For example, a noisy analog signal from a joystick can be cleaned using electronic filtering methods known in the art. Next, the filtered signal is passed to the microcontroller 215. The microcontroller 215 can have access to a stored configuration file containing instructions for converting the control signals provided by the work machine into new, usable signals for controlling and powering a third-party work machine attachment. For example, the microcontroller can convert the analog signal described above into a digital signal, which may be the type required by the work machine attachment to function properly. The microcontroller 215 can send the new control signals to the switches module 220 which can cause switches to operate accordingly, e.g., open or close, to cause signals to be sent to the harness 225. The harness can channel signals from the switches to the appropriate attachment, e.g., attachment 1 (230), causing the work machine attachment to operate. In a preferred embodiment, the microcontroller 215 outputs both control signals and power control signals, which may be of different signal type, simultaneously. Thus, the power control signal, which may activate a solenoid that controls hydraulic flow, is transmitted simultaneously with a control signal, which may control movement or other functions of a work machine attachment.

Figure 3:
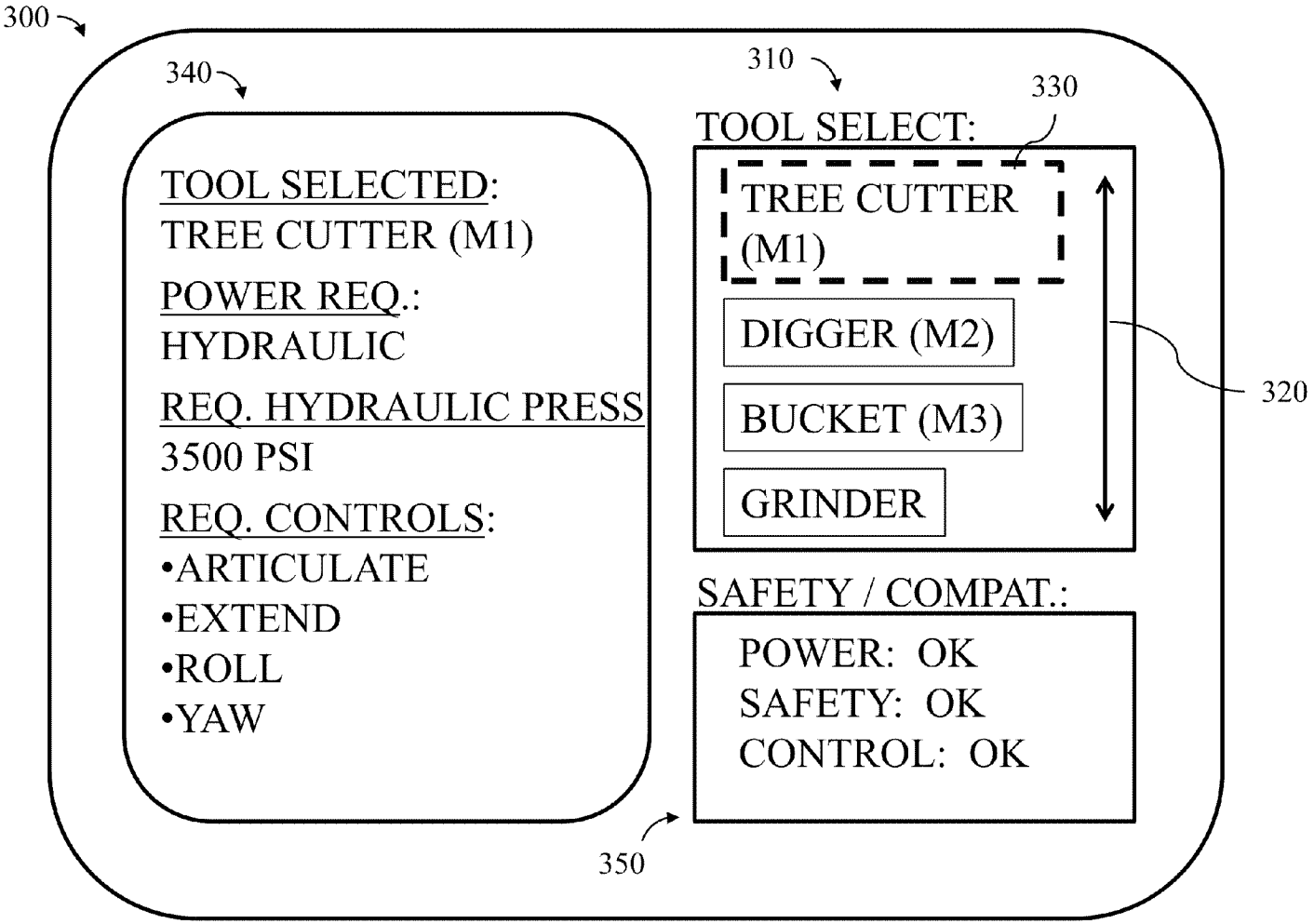
FIG. 3 shows a graphical user interface, according to one embodiment.

Referring now to FIG. 3, an ECSMS GUI is shown, according to one embodiment. FIG. 3 shows an exemplary screen snapshot of the GUI; it will be understood, however, that many additional features, controls, and other GUI elements can be included, as those skilled in the art will recognize. The GUI is capable of communicating with one or more selected components of the ECSMS, e.g., microcontroller(s), memory, storage, etc., and is capable of causing ECSMS programs, instructions, and other code to be executed. In a preferred embodiment, the GUI can be placed proximate to a work machine operator, e.g., inside a cab, so that the operator can choose the appropriate ECSMS software configuration to execute based on the work machine attachment used.

The GUI includes a screen 300, which can be a touch screen, a monitor, a heads-up display, or other display device. While not shown in FIG. 3, if the GUI is a monitor, it will be understood that other computer devices and peripherals (such as a computer mouse) may be necessary to drive the monitor and cause the GUI to display information as described herein. In general, a personal computer, laptop, tablet, or other computing device can be used to drive the GUI and interact with various components of the ECSMS, as will be apparent to those skilled in the art of computer programming. For illustrative purposes, this embodiment is described as if the screen 300 is a touch screen.

In this embodiment, the screen 300 includes a "TOOL SELECT" section 310. This section can include a list of work machine attachments that the ECSMS is capable of powering, controlling, or simultaneously powering and controlling. In certain embodiments, the TOOL SELECT section 310 can include a list of work machine attachments for which a configuration file exists in a memory module of the ECSMS. Additional work machine attachments can be viewed beyond those immediately shown in the section as indicated by the scroll arrow 320. In one embodiment, a user can view additional choices, e.g., by a vertical finger swipe across a portion of the TOOL SELECT section 310.

In this embodiment, touching the name of a work machine attachment causes that portion of the TOOL SELECT section 310 to be highlighted. Here, the user has selected the TREE CUTTER work machine attachment, as illustrated by the dashed line 330. In this and other embodiments, certain manufacturer information can be displayed to the user to aid in the correct choice of selecting a particular configuration file. In this example, the tree cutter attachment is manufactured by a first manufacturer (indicated by "M1" next to the attachment type); the digger is manufactured by a second manufacturer ("M2"); and the bucket is a third-party attachment manufactured by a third company ("M3").

Furthermore, in this embodiment, touching the name of a work machine attachment in the TOOL SELECT section 310 can cause information about that attachment to be displayed in an information area 340. This example shows that the M1-brand tree cutter requires hydraulic power, 3500 psi of hydraulic pressure, and control requirements include articulation, extension, roll, and yaw capabilities. It will be understood that additional information can be included in the information area 340 and that the information shown in FIG. 3 is for illustrative purposes.

In this embodiment, the screen 300 includes a safety and compatibility ("SAFETY/COMPAT.") section 350. In this and other embodiments, the ECSMS can be capable of determining whether a work machine has the requisite (or appropriate) hardware to power, control, or power and control the attachment within its recommended range of usability. For example, the ECSMS can include a configuration file that includes specifications of the work machine. Specifications of the work machine can include engine size and power output, the number, placement, and power output of hydraulic cylinders, range of motion and degrees of freedom of arms, booms, and other features, mobility, tolerances, maximum and do-not-exceed usable weights, among other specifications. In one embodiment, the ECSMS is capable of "pinging" the various control and power implements on a work machine to gather status of the overall machine and any necessary hardware; in other embodiments, this information can be sought from manufacturers of work machines and integrated into an ECSMS configuration file, for example. The ECSMS can be capable of communicating with measurement devices, such as pressure-measuring devices, to ensure that proper hydraulic pressure is available to power a certain attachment. In one embodiment, an ECSMS is capable of communicating with diagnostic features or systems of a work machine. In such an embodiment, the ECSMS can determine from the diagnostic information if a fault exists somewhere in the system, which can occur, e.g., from a ruptured hydraulic cylinder, a frozen or jammed joint on an arm, engine failure or reduction of power, etc.

Still referring to FIG. 3, the safety and compatibility check section 350 can indicate to the user that the power, safety, and control requirements have been met and are operational for the selected configuration, i.e., the tree cutter. In this embodiment, in order to pass the "power" test, the ECSMS can, e.g., determine that there is ample hydraulic or electric power being produced by the work machine, that the connections have been made, solenoids and motors are functional, and that the attachment is actually receiving power and control signals. To pass the "safety" check, the ECSMS can run a diagnostic check to ensure that the attachment matches the loaded configuration before any operator control signals are sent to the attachment. To pass the control check, the ECSMS can send a pre-determined set of control instructions to the attachment, monitor the actual movement or actuation of the device, and ensure that the physical movement is within established control parameters.

In one embodiment, an ECSMS is capable of automatically loading one or more configuration files or instructions for a given attachment. For example, an ECSMS can communicate with an identification module and any related hardware (which may, in some embodiments be integral with the ECSMS) that identifies a work machine attachment. A work machine attachment can be identified by any method known in the art, including, but not limited to: use of bar codes and bar code readers, radio-frequency identifiers (RFID's), transmitters and receivers (e.g., fobs), image extrapolation and recognition, and other identification methods. In one exemplary use of such a feature, an ECSMS can include, e.g., ten different configuration files including instructions for powering, controlling, or powering and controlling ten different machine attachments. Each configuration file can, therefore, include specific instructions for controlling each machine attachment when it is attached to the work machine. The work machine can be capable of reversibly self-attaching any of the ten attachments, e.g., at the end of a boom. The user can, e.g., drive a work machine up to the attachment, and as the implement is attached, the ECSMS can recognize the attachment and load the appropriate configuration file for powering, controlling, or powering and controlling the attachment as described herein.

It will be understood that the foregoing example discloses a few out of many possibilities for GUI functionality. For example, the ECSMS can include peripheral hardware and software to allow personal computing tablets, phones, and handheld devices to communicate with the ECSMS and control its functionality as described herein. In one example, a personal computing tablet such as that manufactured under the "iPad" brand (Apple, Inc.) can be used to communicate with an ECSMS to control its functions, including downloading data to the tablet, such as productivity, hours worked, engine diagnostics, work machine attachment usage data, and other data.

Figure 4:
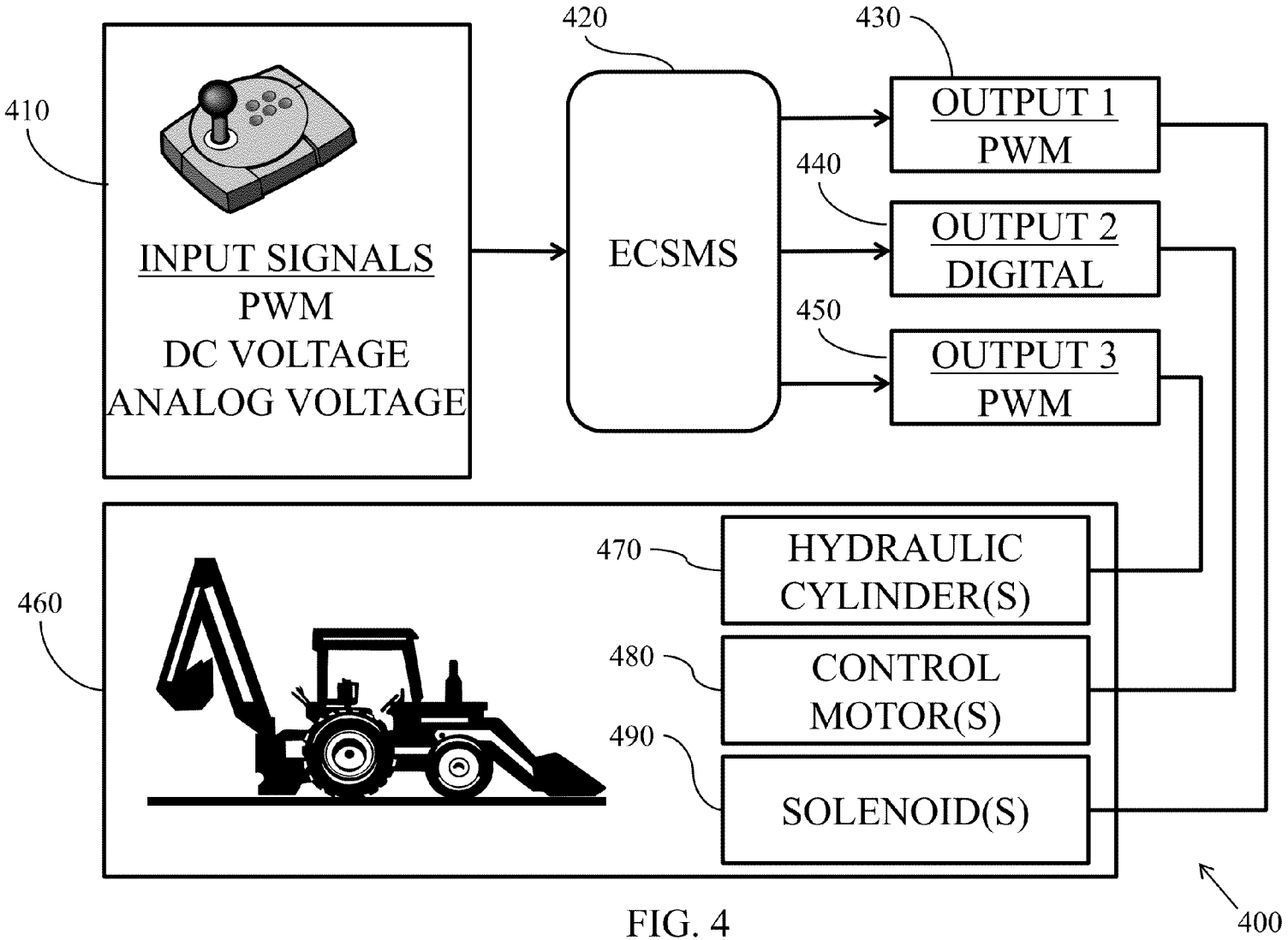
FIG. 4 shows a system for controlling a work machine attachment, according to one embodiment.

Referring now to FIG. 4, a system 400 for powering, controlling, or powering and controlling one or more work machine attachment(s) is shown, according to one embodiment. The system 400 schematically represents some of the features that can be found on a work machine, however, it will be understood that various components have been omitted for clarity and to focus on transmission of power and control signals throughout the vehicle.

The system 400 includes a signal source 410 capable of generating control, power, or control and power input signals. The signal source 410 can be, for example, a joystick configured to control one or more attachments, arms, booms, or other features of a work machine. The signal source 410 may be configured to control a plurality of mechanisms on a work machine attachment. For example, some work machine joysticks are capable of moving in four directions (up, down, left, and right) so as to control movement of the work machine in a desired direction (forward, backward, left, and right, respectively). The joystick may also include triggers or other controls on the head of the joystick that control functionality of a work machine attachment. For example, some joysticks include control features for controlling motion of a digger attachment so that the user is capable of scooping and digging with the attachment. Depending on the manufacturer and other considerations, the signal source 410 may emit control signals in a variety of different formats, e.g., PWM, DC voltage, analog voltage, etc., as will be recognized by those skilled it the art. It is a common practice that manufacturers of work machines and work machine attachments build systems that communicate using the same signal format; e.g., a work machine built by a first manufacturer may integrate a signal source that utilizes digital control signals, and any attachments made for that work machine would correspondingly require the same signal format to function properly. A third-party attachment, however, may not be expected to work as intended utilizing the existing controls of a given work machine.

The system 400 includes an ECSMS 420 that is capable of receiving the input signals from the signal source 410. The ECSMS 420 can be, e.g., an ECSMS as described herein. The ECSMS 420 is capable of receiving one or more control, power, or control and power inputs from the signal source 410. In some embodiments, the ECSMS 420 is capable of receiving control, power, or control and power signals from a plurality of signal sources, for example, when a work machine includes several control joysticks, or utilizes multiple levers, controls, pedals, or other devices to control the work machine and its attachments or implements.

As previously described, the ECSMS 420 is capable of receiving signals from the signal source 410, and converting those signals into control, power, or control and power signals for any type of work machine attachment. In the illustrative example of FIG. 4, the "hard-wired" input signals from the signal source 410 are a PWM signal, a DC voltage signal, and an analog signal. These signals may be the only output of the signal source 410, and they may be configured specifically so that an attachment made by the same company as the work machine can be controlled. However, a third-party attachment may require a PWM signal to control one or more hydraulic cylinder(s) (output 1, 430), a digital signal to control one or more control motor(s) (output 2, 440), and a PWM signal to activate one or more solenoid(s) (output 3, 450). As shown in FIG. 4, the ESCMS 420 can convert the signal inputs from the signal source 410 into the requisite signal type as required by the work machine attachment.

In this example, the ECSMS 420 may pass the PWM input signal through to OUTPUT 1 (430) without any conversion (in some embodiments, the signal may be filtered, amplified, or otherwise conditioned to meet the signal requirements of the attachment, however). In this example, the DC voltage from the signal source 410 may be converted by the ECSMS 420 into a digital output signal (OUTPUT 2, 440) that controls a control motor 480 for the work machine attachment. Similarly, in this example, the analog voltage signal can be converted to a PWM signal (OUTPUT 3, 450) for controlling one or more solenoids 490.

EXAMPLE

With reference to FIGS. 5A-5E, the following example of an ECSMS 500 represents one embodiment of the attachment control signal modulator concepts provided herein. It will be understood that the circuit configuration, wiring, machinery, and other components of the ECSMS 500 shown in FIGS. 5A-5E are provided for illustrative purposes and are non-limiting with respect to the claims. Other embodiments and alternatives to the circuit configuration, wiring, machinery, and other components of the ECSMS 500 are equally contemplated.

Referring now to FIGS. 5A-5E, an ECSMS 500 is shown, according to one embodiment. The ECSMS 500 can be used to control a motor grader attachment manufactured by Bobcat Company, using a Model 299C multi-terrain loader manufactured by Caterpillar, Inc. The mutli-train loader includes a four-switch PWM control pod, Caterpillar part number 292-8706, that the operator can use for manipulating various attachments. Bobcat Company's corporate headquarters are located in West Fargo, N.Dak., USA; Caterpillar, Inc. has corporate headquarters are located in Peoria, Ill., USA. In this example, reference is made to FIG. 1, which shows a Caterpillar model 299C multi-terrain loader and Bobcat grader attachment; the ECSMS is not shown in FIG. 1, however, the ECSMS can be attached to the multi-terrain loader or grader attachment in a chosen location.

In this particular example, the blade 106 of the motor grader attachment 105 (FIG. 1) has the capability to be moved in eight distinct directions: left-side up, left-side down, right-side up, right-side down, blade rotate left, blade rotate right, blade shift left, blade shift right. Movements are powered using one or more hydraulic cylinders which are each activated by a solenoid; e.g., the left-side up/down movement can be controlled by a left-side hydraulic cylinder; the right-side up/down movement can be controlled by a right-side hydraulic cylinder, etc. It will be understood that an ECSMS of the type described herein can be expanded to control any number of hydraulic cylinders or other power plants to gain complete control of various attachment functionality.

Figure 5A:
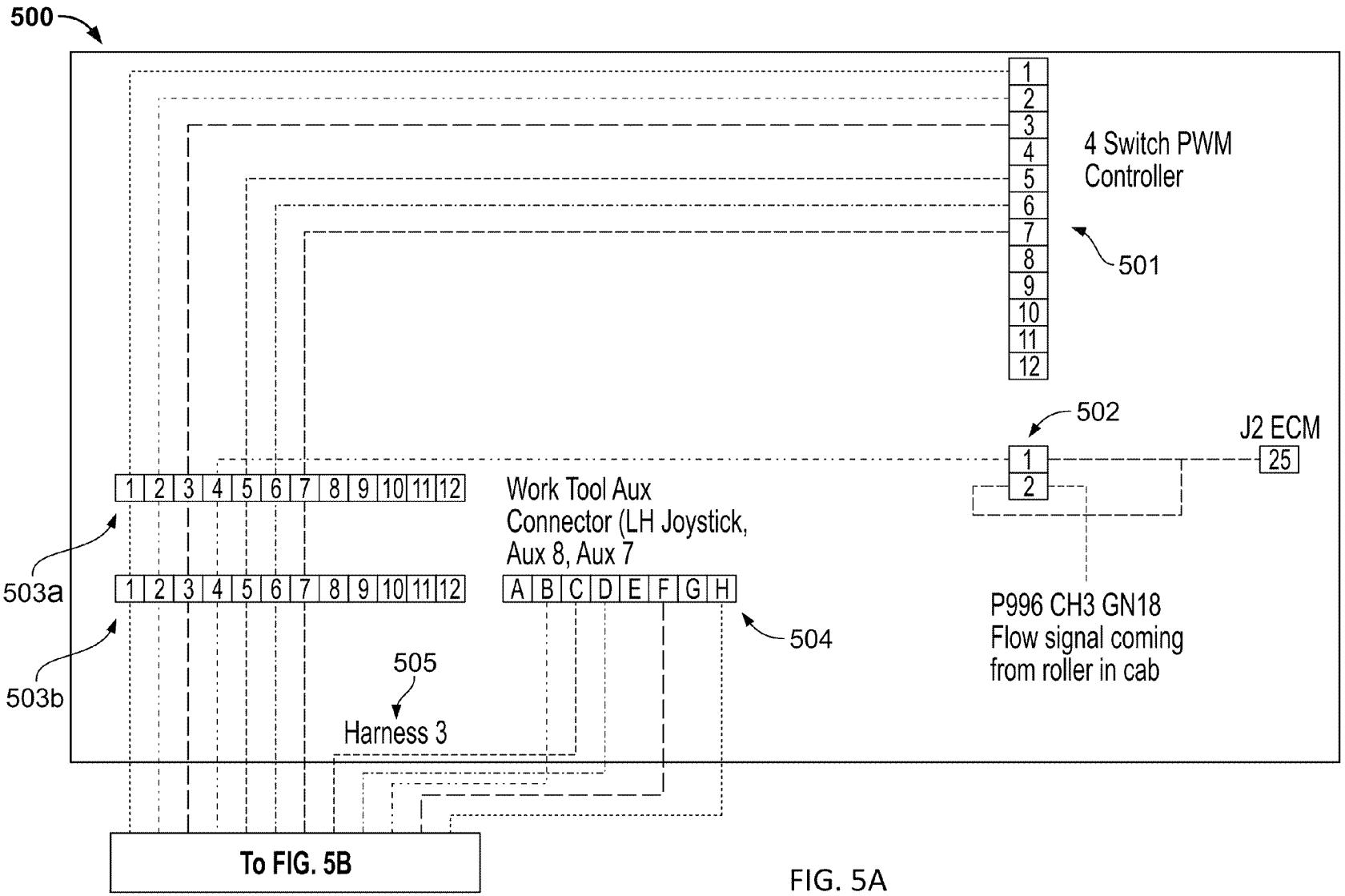
FIGS. 5A-5E show an exemplary circuit diagram corresponding to an electronic control and modulation system, according to one embodiment.

Referring now to FIG. 5A, the signal wiring from the control pod output is wired to harness connector 501. In this example, the four-switch control pod is capable of providing eight PWM signals via six input lines which are shown attached to terminals 1, 2, 3, 5, 6, and 7 in harness connector 501. Harness 501 is in signal communication with double harness 503 via wiring as shown. The wiring from double harness 503 continues in FIG. 5B.

Harness connector 504 receives wired input from a control joystick located in the cab of the multi-terrain loader. Harness connector 504 can be used in this and other embodiments to receive control signals from auxiliary control mechanisms, or to provide the capability for controlling additional attachments. In this embodiment, cable from the joystick controller of the multi-terrain loader carrying control output signals is connected to harness connector 504 to provide additional control of the motor grader attachment.

Harness connector 502 is two-pin connector; terminal 1 from this connector is wired to the grader's ECM to control hydraulic flow in the attachment, thus providing the necessary power to move and control the grader blade 106 (FIG. 1). Terminal 2 in this connector can receive input hydraulic flow signals from the controller pod or other auxiliary control mechanisms. If the input signal received at terminal 2 of harness connector 502 is of the correct type to co control hydraulic flow, e.g., PWM, the signal can be passed directly to the ECM as illustrated. In other cases, hydraulic flow signals can be generated by the microcontroller from other signal types as described in herein; in the illustration of FIG. 5A, the wiring for these signals enters from FIG. 5B, as shown. Harness 505 bundles the cable as shown; the circuit continues in FIG. 5B, as illustrated.

Figure 5B:
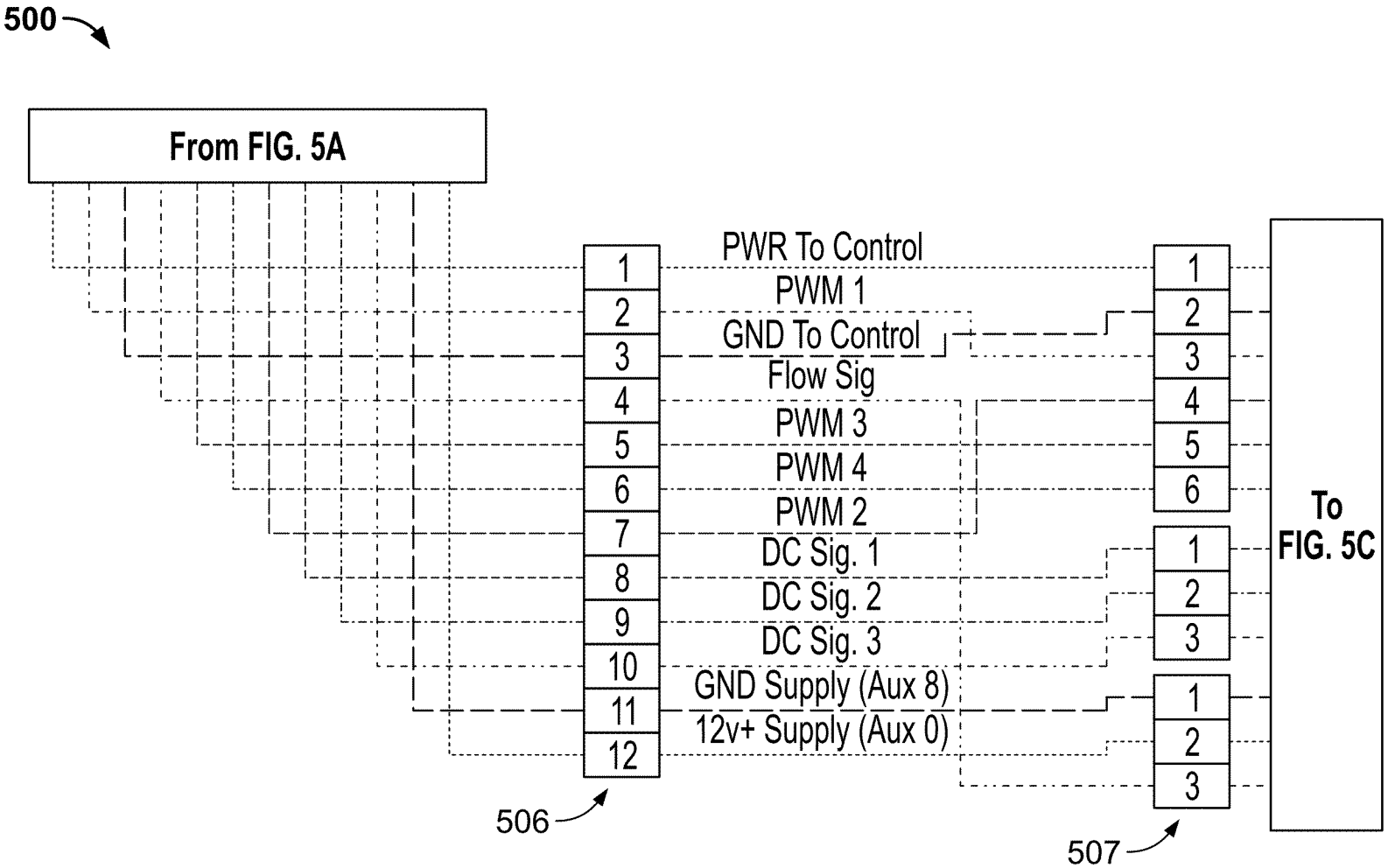

Referring now to FIG. 5B, the wiring from harness connector 505 is connected to harness connector 506 as shown. The various signals in each wire leading from the twelve terminals in harness connector 506 are labeled in FIG. 5B, and each wire connects to connector harness 507 as illustrated. The circuit extends into FIG. 5C as illustrated.

Figure 5C:
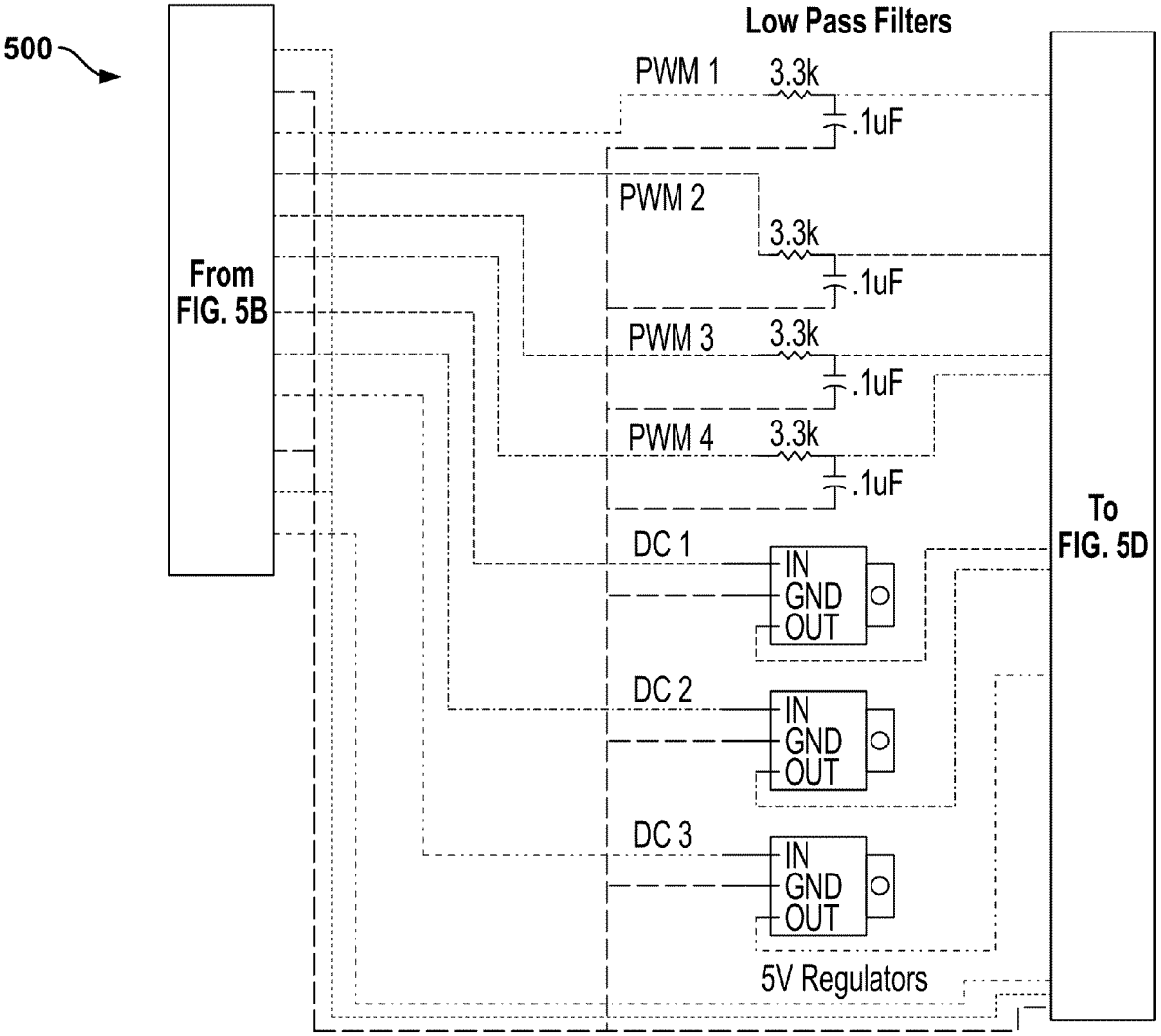

Referring now to FIG. 5C, the PWM1, PWM2, PWM3 and PWM4 signals are passed through low-pass filters. In this embodiment, the low-pass filters include a 3.3 kΩ resistor and a 0.1 μF capacitor, although other electronic filters can be used. The DC1, DC2, and DC3 signals are passed through 5 V regulators; the power-to-control, PWM1, and hydraulic flow signals are not filtered or regulated in this embodiment. As described herein, the filters and regulators can process control signals from control mechanisms so that they may be input into the microcontroller safely and within input tolerance limits. The wiring continues in FIG. 5D, as illustrated.

Figure 5D:
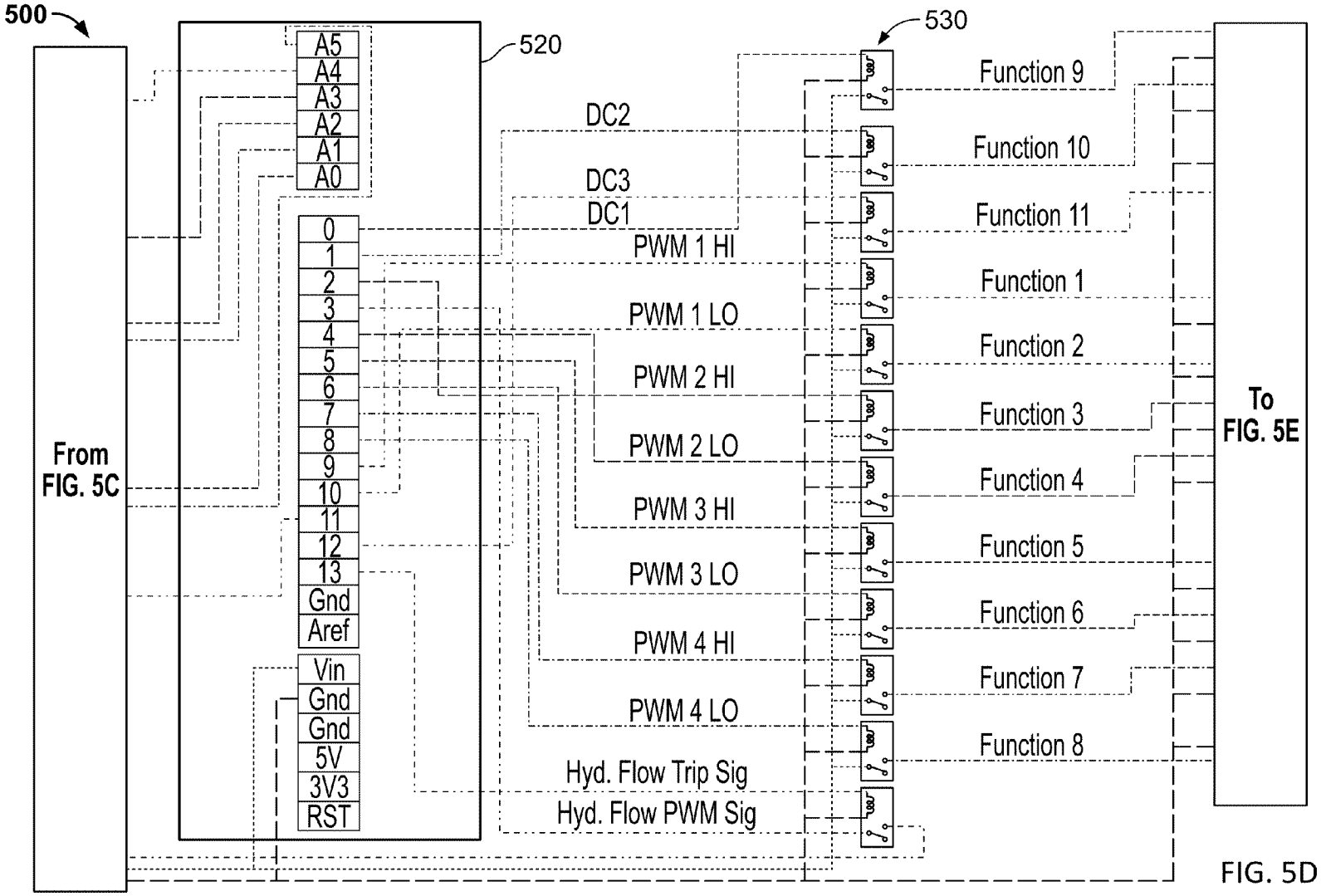

Referring now to FIG. 5D, in this embodiment, the control signals are fed into a microcontroller 520 which, in this embodiment, is an Atmega328 RISC-based microcontroller. As described herein, the microcontroller can be programmed to be capable of receiving a signal of a particular type, e.g., PWM, DC, or analog voltage, and transforming the signal to a different signal type, e.g., PWM, AC voltage, DC voltage, frequency, etc. In this example, the four-switch PWM controller provided PWM output control signals; however, the motor grader attachment 105 (FIG. 1) required 12 VDC signals to activate the various solenoids in order for the blade 106 (FIG. 1) to be moved under hydraulic power as described above. In addition, the attachment 105 was configured to receive PWM signals at a specific duty cycle to activate hydraulic flow.

Pins A5 through A0 serve as the input to the microcontroller. The PWM1, PWM2, PWM3, and PWM4 signals are converted to analog signals by the low-pass filters and connect to pins A4, A3, A2, and A1, respectively, as shown. DC1 and DC2 are voltage-regulated digital signals that connect to pins A0 and A5, respectively, as shown. Pins 0-15 are digital input/outputs of the microcontroller. In this embodiment, the microcontroller processes the various input signals and provides digital output signals, with the exception of the DC3 signal, which is already a digital signal, and feeds through pin 11, as shown.

The digital output signals connect to 5V, 0.5A single-pole, double throw (SPDT) relays as shown. Closing a relay provides a 12 V output signal capable of activating a solenoid on the attachment 105 (FIG. 1). Functions 1-8 as illustrated in FIG. 5D correspond to the eight possible motions of the grader blade 106 (FIG. 1), e.g., left-tilt up, left-tilt down, etc., as previously described. Functions 9-11 provide the capability for additional attachment functionality, e.g., an auxiliary steering mechanism, a tilt mechanism, or other features.

Pin 13 is an output carrying a digital hydraulic flow trip signal which is similarly connected to a SPDT relay as shown. Activation of this relay sends a digital hydraulic flow signal to terminal 1 of harness connector 502, which, as heretofore described, is plugged in to the attachment ECM and can activate hydraulic flow. Thus, the microcontroller can output a function control signal which activates a particular solenoid on the attachment (e.g., function 1, left-tilt up) and simultaneously output a hydraulic flow signal which activates hydraulic flow to the cylinder and provides the power to perform the desired function. The wiring extends to FIG. 5E, as illustrated.

Figure 5E:
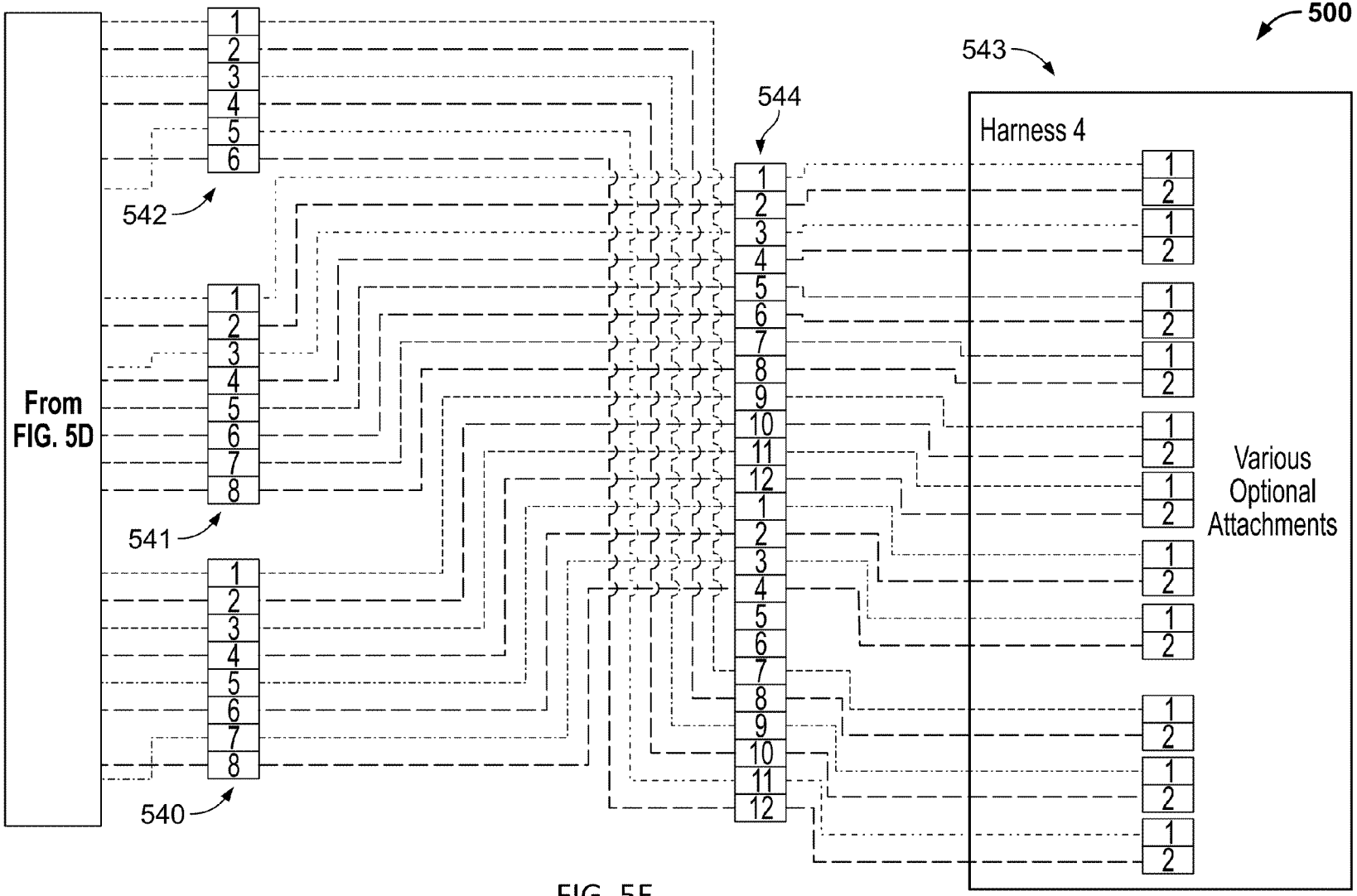

Referring now to FIG. 5E, in this embodiment, the wiring from the various switches 530 connect to one of three harnesses 540, 541, 542. Wiring from those harnesses extend to an output harness 543. As described herein, the output harness 543 can be connected to any type of connector known in the art so that the output signals of the ECSMS can be passed to the attachment control and power systems (not shown in FIGS. 5A-5E for clarity).

Figure 6:
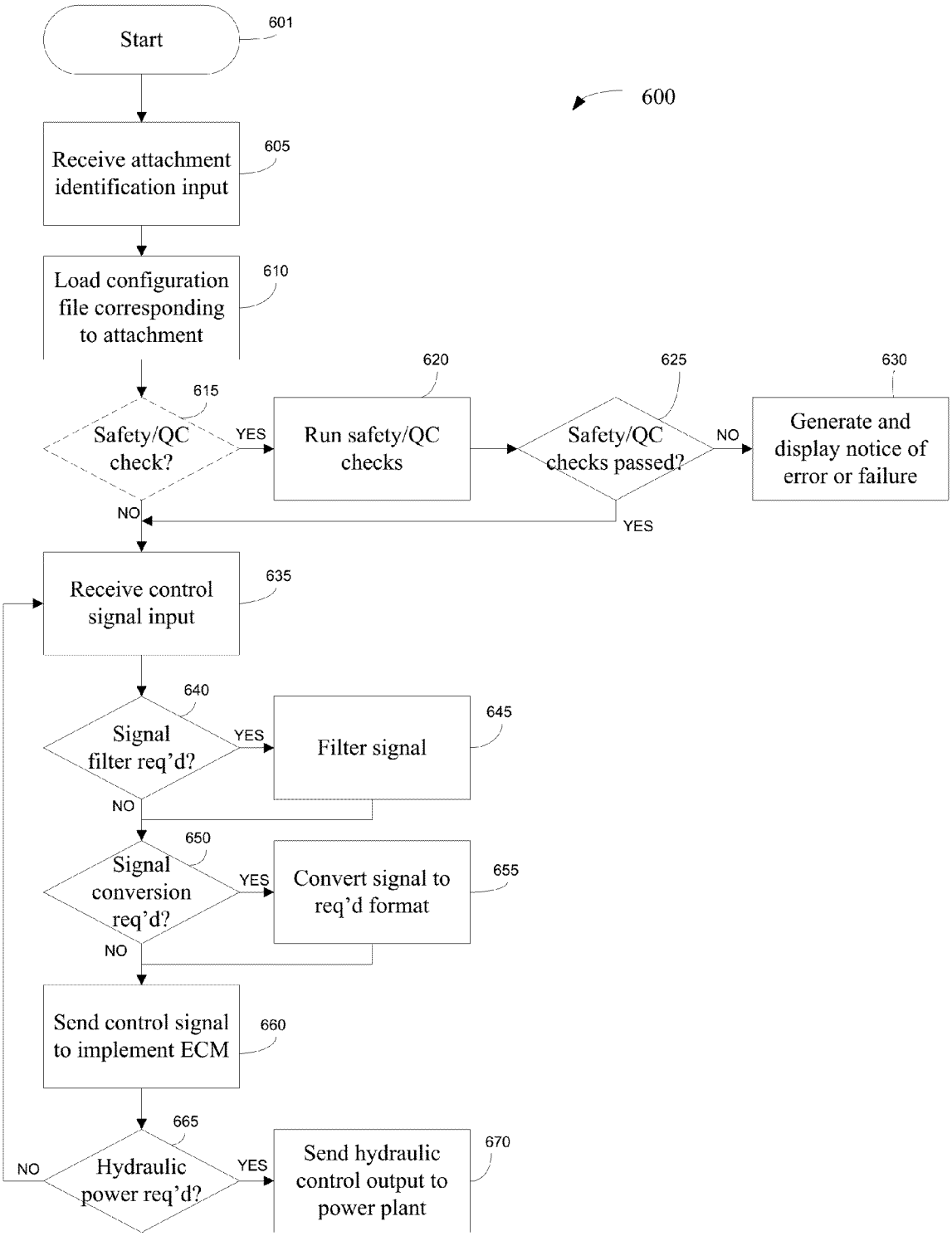
FIG. 6 shows a method for controlling a work machine attachment, according to one embodiment.

Referring now to FIG. 6, a computer-implemented method 600 for controlling a work machine implement or attachment is shown in flowchart form, according to one embodiment. In various embodiments, the method 600 can be stored as computer-executable instructions, e.g., software, and stored in a computer-readable medium, such as on a hard drive, in memory, e.g., a flash drive, in RAM or ROM, or other media. In this embodiment, the method begins at step 601. Step 601 can include auxiliary functions, such as receiving power to a computer capable of executing the method 600, performing boot operations, etc. This method 600 can be performed in cooperation with existing hardware, software, or other components of a work machine, as described herein.

In this embodiment, at step 605 an identification of an attachment is received. The identification step can include, e.g., receiving user input that identifies an attachment, recognition of an attachment using auxiliary optical recognition hardware and software, recognition of an attachment using bar code readers, FOBs, RFID systems, and other methods of recognizing a work machine attachment.

In this embodiment, at step 610 one or more configuration files including control parameters of the recognized work machine attachment are loaded. Control parameters can include, without limitation, the type of input control signals required for the attachment to function as intended, e.g., PWM, analog, etc. Control parameters can also include, without limitation, functional characteristics of the attachment, such as load and movement limits, optimal hydraulic power parameters, do-not-exceed limits, and other parameters as described herein.

In this embodiment, at step 615, an optional (as denoted by the dashed line) safety or quality control (QC) check can be performed. If such a check is desired, stored parameters of the attachment or the work machine itself can be checked to ensure proper functioning of the machines (step 620). Step 620 can include, without limitation, ensuring that the work machine and work machine attachment are functioning within established parameters, e.g., operating temperatures are within limits, hydraulic power is present and functional, etc. If an error, failure, or other parameter of the safety check does not meet the standards or requirements (step 625), then, at step 630 an error message can be generated and sent to a display device so that the user of the work machine can address the problem.

If the work machine and attachment pass the safety/quality control checks (step 625), then, in this embodiment, step 635 includes receiving a control signal input at an input register. In this and other embodiments, an input register can include, e.g., an input register associated with the control inputs and configurations module 205 described with respect to FIG. 2, or the ECSMS 420 described with respect to FIG. 4. The control signal input can be input generated, e.g., by a control mechanism integral with the work machine, such as a joystick, lever, pedal, knob, switch, or other control mechanisms, including those described herein.

In this embodiment, step 640 includes determining, e.g., based on the configuration file loaded in step 610, whether or not the control input signal should be electronically filtered as described herein. If filtering is required, or would result in improved performance, then, at step 645 the control signal input can be electronically filtered, e.g., as described herein. If, however, electronic filtering of the signal is not required, or would not result in improved performance, the filtering step 645 can be ignored.

In this embodiment, step 650 includes determining, e.g., based on the configuration file loaded in step 610, whether or not the control input signal should be converted from the format as received (e.g., PWM), or if the signal should be converted to another format (e.g., digital) so that the attachment will respond substantially as the user intends, e.g., according to the control signals he or she generates using the control mechanism.

In this embodiment, if the work machine attachment requires a different control signal format than that output by the control mechanism, then, at step 655, the input control signals can be converted to the appropriate format as described herein. If, however, the control signals generated by the control mechanism are suitable to control the attachment as intended, then the conversion step 655 can be ignored.

In this embodiment, at step 660 the appropriate control signal, either that generated by the control mechanism of the work machine, or a control signal of appropriate format to control the attachment generated in step 655 can be sent to an output register. The output register can be in signal communication with, e.g., an electronic control module that controls the operation (e.g., movement or other parameters) of the attachment, or any other control system (including direct control) that controls the attachment.

In this embodiment, step 665 includes determining, e.g., based on the configuration file loaded in step 610 whether or not a concurrent hydraulic flow signal should be output, e.g., to the aforementioned output register, so that the attachment will receive a hydraulic flow signal concurrently with the control signal sent to the attachment (or the ECM of the attachment) in step 660. In some embodiments, the length of time that a hydraulic flow output signal persists can be defined in the aforementioned configuration file. In some embodiments, the hydraulic flow output signal generated in step 670 can persist as long as a control output signal (step 660) is being sent to the attachment (or ECM of the attachment). In an exemplary embodiment, the hydraulic flow output signal generated at step 670 can be terminated concurrently with the termination of the output control signal generated at step 660.

In this embodiment, the method 600 includes a loop from step 665 to step 635, so as to continually receive control signal inputs from the user via the control mechanism, and produce control signal outputs formatted in the correct signal type that the work machine attachment responds and is controllable as intended by the user.

In this embodiment, the method 600 can be executed continuously, e.g., for as long as the work machine and attachment are being used. In addition, multiple instantiations of the method 600 can be executed by a computer system simultaneously. For example, a first, second and third instantiation can be used for controlling first, second and third attachments or implements respectively, coupled to a work machine. In another example, a first instantiation of the method 600 can be used to control one aspect of a work machine attachment, e.g., the articulation of a crane arm, and a second instantiation can be used for controlling a second aspect of the attachment, e.g., a bucket.

A number of illustrative embodiments have been described. Nevertheless, it will be understood that various modifications may be made without departing from the spirit and scope of the various embodiments presented herein. For example, various attachments have been described herein and used as examples of work machine implements. It will be understood, however, that those implements described herein are merely representative of a large number of commercial and custom work machine attachments available throughout the world. A work machine "attachment" or "implement" as used herein generally refers to a hydromechanical work tool, utensil, or other piece of equipment, which can be configured, adapted, or used for a particular purpose; however, these terms do not exclude non-hydromechanical work tools, utensils, or other pieces of equipment. The term "manufacturing company" as used herein refers to companies that manufacture work machines or work machine implements, although those companies may additionally design, distribute, sell, or engage in other commercial and developmental matters related to work machines and work machine implements. Accordingly, other embodiments are within the scope of the following claims.

What is claimed is:

1. A system for controlling a work machine implement, comprising:

an electronic control module configured to receive, at one or more input registers, an input control signal of a first control signal type generated by a control mechanism of said work machine corresponding to a user input, and further configured to generate a control output signal of said first control signal type or of a second, different control signal type for controlling operation of said implement according to said user input;

wherein said generating an output signal causes simultaneous or substantially simultaneous generation of a hydraulic flow output control signal for providing hydraulic power to said implement; and wherein said control output signal and said hydraulic flow output control signal are transmitted to an output register.

2. The system of claim 1, wherein said hydraulic flow output control signal is in signal communication with an electronic control module of said work machine that is capable of controlling hydraulic flow to a hydraulic motor or hydraulic cylinder integral with said work machine implement.

3. The system of claim 1, wherein the manufacturing company of said work machine is different from the manufacturing company of said implement.

4. The system of claim 3, wherein said implement includes an auxiliary electronic control module configured to control movement or functionality of said implement using one or more hydraulic systems according to said control output signal.

5. The system of claim 1, wherein said electronic control module comprises a microcontroller in signal communication with said one or more input registers capable of storing and executing software instructions for converting said one or more input control signals from said first control signal type into said control output signals of said second control signal type, alone, or optionally in cooperation with one or more electronic filter components.

6. The system of claim 5, wherein said microcontroller is capable of storing one or more configuration files comprising said software instructions for a chosen combination of work machine and implement.

7. The system of claim 6, further comprising a selection mechanism for a user to select one of said configuration files to be executed by said microcontroller according to a chosen combination of work machine and implement.

8. The system of claim 7, wherein said selection mechanism is a computer-driven graphical user interface, a switch, a rotary dial, a lever, or a button.

9. The system of claim 5, further comprising one or more optional electronic filters and one or more optional electronic regulators in signal communication with said input control signals capable of conditioning said one or more input control signals according to desired signal input specifications of said microcontroller.

10. The system of claim 1, wherein said first control signal type is a pulse-width modulated (PWM) signal, an analog signal, a digital signal, an alternating-current signal, or a direct-current voltage signal.

11. The system of claim 1, wherein said control mechanism is a joystick, lever, throttle, auxiliary control module, pedal, switch, roll-knob, or control bar.

12. The system of claim 1, wherein said work machine is a skid-steer loader, an excavator, a multi-terrain loader, a telehandler, a track loader, a track-type tractor, a wheel loader, a wheel dozer, a motor grader, or a backhoe loader.

13. The system of claim 1, wherein said implement is one or more of a: motor grader, backhoe, hydraulic breaker, fork, pallet fork, broom, angle broom, sweeper, auger, mower, snow blower, grinder, stump grinder, tree spade, trencher, dumping hopper, ripper, tiller, grapple, tiller, roller, blade, snow blade, wheel saw, cement mixer, bucket, clamp, digger, cutter, grader, grapple, breaker, mower, rake, planer, compactor, ripper, scraper, seeder, sprayer, spreader, trencher, plow, roller, wheelsaw, post driver, dumping hopper, chipper, or wood chipper.

14. A method for controlling an implement of a work machine, comprising:

receiving an implement control signal in a first signal format from a work machine implement control mechanism at an input register of a conversion module, wherein said conversion module comprises a microcontroller in signal communication with said input register, and wherein said microcontroller is configured to store and execute computer software instructions for converting said implement control signal from said first signal format to a second, different signal format; and transmitting said implement control signal in said second signal format to an electronic control integral with said implement that is configured to receive control signals of said second signal format to engender user-controlled motion or activation of said implement.

15. The method of claim 14, further comprising:

generating a hydraulic flow activation signal that corresponds with said converting said implement control signal from said first signal format to a second signal format and transmitting said hydraulic flow activation signal to an input register of a hydraulic power system integral with said implement, to cause hydraulic flow in said hydraulic power system to occur only when said implement is in motion or activated.

16. The method of claim 14 wherein said first or said second control signal format is a pulse-width modulated (PWM) signal, an analog signal, a digital signal, an alternating-current signal, or a direct-current voltage signal.

17. The method of claim 14, wherein said implement control mechanism is a joystick, lever, throttle, auxiliary control module, pedal, switch, roll-knob, or control bar.

18. The method of claim 14, wherein said work machine is a skid-steer loader, an excavator, a multi-terrain loader, a telehandler, a track loader, a track-type tractor, a wheel loader, a wheel dozer, a motor grader, or a backhoe loader, and wherein said implement is one or more of a: motor grader, backhoe, hydraulic breaker, fork, pallet fork, broom, angle broom, sweeper, auger, mower, snow blower, grinder, stump grinder, tree spade, trencher, dumping hopper, ripper, tiller, grapple, tiller, roller, blade, snow blade, wheel saw, cement mixer, bucket, clamp, digger, cutter, grader, grapple, breaker, mower, rake, planer, compactor, ripper, scraper, seeder, sprayer, spreader, trencher, plow, roller, wheelsaw, post driver, dumping hopper, chipper, or wood chipper.

19. A computer program product tangibly embodied in a non-transitory information carrier, the computer program product including instructions that, when executed, perform operations for controlling a work machine implement that is configured to receive operative control signals in a format that is different from the signal format of the implement control system of said work machine, the operations comprising:

receiving an implement control signal in a first signal format from said implement control system of said work machine at an input register of a conversion module, wherein said conversion module comprises a microcontroller in signal communication with said implement control system, converting said implement control signal from said first signal format to a second, different signal format;

transmitting said implement control signal in said second signal format to an electronic control integral with said implement that is configured to receive control signals of said second signal format so as to engender user-controlled motion or activation of said implement.

20. The computer program product of claim 19, further comprising:

selecting, through a graphical user interface, a configuration file corresponding to a specific combination of work machine type and implement type; and displaying, on said graphical user interface, selected operational data corresponding to the usage of said implement.

* * * * *